United States Patent [19]

Cohen

[11] Patent Number: 4,810,125

[45] Date of Patent: Mar. 7, 1989

[54] RING MECHANISM

[76] Inventor: Lewis Cohen, 205 The Bridle Path, Toronto, Ontario, Canada, M3C 2P6

[21] Appl. No.: 139,882

[22] Filed: Dec. 30, 1987

[51] Int. Cl.[4] ..... B42F 3/04
[52] U.S. Cl. ..... 402/37
[58] Field of Search ..... 402/36, 37, 38, 39, 402/40, 41

[56] References Cited

U.S. PATENT DOCUMENTS

| | | | |
|---|---|---|---|
| 959,183 | 5/1910 | Trussell et al. | 402/38 |
| 1,575,591 | 3/1926 | Newman | 402/37 |
| 2,760,490 | 8/1956 | Schadf | 402/37 |

FOREIGN PATENT DOCUMENTS

| | | | |
|---|---|---|---|
| 826276 | 12/1959 | United Kingdom | 402/37 |

*Primary Examiner*—Paul A. Bell
*Attorney, Agent, or Firm*—Rogers, Bereskin & Parr

[57] ABSTRACT

A ring mechanism has a cover rail, and a pair of carrier rails nested in side by side relationship between the side edges of the cover rail. Ring elements are mounted on the carrier rails, and the carrier rails can be moved between open and closed over center positions. To lock the carrier rails, a locking member is provided. In one position, it permits free movement of the carrier rails. In a locking position, it engages the carrier rails to prevent them being moved from the closed over center position, thereby preventing opening of the ring elements.

11 Claims, 3 Drawing Sheets

RING MECHANISM

FIELD OF THE INVENTION

This invention relates to a ring mechanism, more particularly a ring mechanism for loose leaf binders and the like.

BACKGROUND OF THE INVENTION

There are a variety of known ring mechanisms. Whilst a large number of different designs have been proposed, current ring mechanisms share a number of basic features or elements. Thus, the main body or base of the ring mechanism is provided by a cover rail, which is pressed from sheet steel. The cover rail has turned in side edges, and includes apertures adjacent the side edges for the ring elements. Additionally, the cover rail is provided with some means for mounting it, usually by rivets, to a ring binder or the like. Within the cover rail, there are a pair of carrier rails in nested side by side relationship. The width of the carrier rails is greater than the width between the sides of the cover rail, in an unstressed condition. Consequently, the carrier rails can be moved between open and closed over centre positions, the resiliency of the cover rail maintaining the carrier rails in these two positions. The ring elements are secured to the carrier rails and extend upwardly through the apertures of the cover rail. The ring elements are arranged in pairs, and each pair has a pair of complementary mesh ends that, in the closed over centre position mesh with one another.

In the development of ring mechanisms, numerous variance and alterations have been suggested. Thus, there have been proposals for a wide variety of different ring profiles. These include circular rings, rectangular rings, ring mechanisms having mixed profiles on either side for the ring elements, and a so-called "slant D" mechanism in which one ring element has a straight, sloping side. Additionally, proposals have been made for various modifications and configurations for the other elements.

At the present time, ring mechanisms are used for a wide variety of different purposes. Thus they can be used by students for storing notes, which can be readily inserted as the notes accumulate. Binder with ring mechanisms can also be used to store a variety of printed material. They are particularly convenient for storing reference material, which is frequently and regularly updated. Thus, there are organizations which need to maintain copies of official government regulations or publications, which are regularly updated. This is simply and easily accomplished, by using the loose leaf format in a ring binder. Then, when any one page is changed, only that page has to be replaced.

At the present time, ring binders (i.e. binders including ring mechanisms mounted within them for holding the sheets) are often used for holding relatively large and voluminous reference works. An example in the patent field is the use of such ring binders for holding patent examining manuals. In many cases, such reference works can contain many hundreds of pages, and consequently the mass or weight of paper is considerable. Equally, in the case of student notes and the like, it happens that a large mass of notes are accumulated and held witin one binder.

For large documents, particularly those with large sheets which are frequently used, sometimes ring mechanisms having more than the usual two or three pairs of ring elements are provided; for example, ring mechanisms sometimes have seven pairs of ring elements. This can increase the durability of the document. Damage to the individual sheets should be reduced, and in any event if only a few holes in any one sheet are damaged, the remaining holes will secure it in place. However, this sort of feature does not address the problem of securely retaining all of the sheets in position.

The ring elements are held in the closed position solely by the resiliency of the cover rail. The edges of the cover rail are held apart by the carrier rails, so that the cover rail in turn presses inwards to maintain the carrier rails in the closed over centre position. However, in the closed position, the inner edges of the carrier rails are only slightly lower than the outer edges thereof. As a consequence, there is a considerable mechanical advantage between the mesh ends of the ring elements and the carrier rails; i.e. a relatively large movement between the mesh ends produces a relatively small movement of the carrier rails.

Whilst in theory, the force needed to displace and open the mesh ends of the ring elements could be made as large as desired by suitable dimensioning of the components, as a practical matter it must be sufficiently low that the ring mechanism can be comfortably operated by the user. The mechanism is opened either by grasping the ring elements and pulling them apart, or by operating a pair of trigger or booster levers at either end that act on the carrier rails. Consequently, one cannot simply provide a heavier gauge cover rail, to ensure that the ring elements are securely held in the closed configuration, as the device may then not be usable.

Where the ring mechanism is dimensioned so that the forces required to open it are comfortable to the user, then it may not provide the required degree of security. Particularly where large and bulky documents or collections of papers are held, the ring mechanism can accidently burst open. This can happen where a binder is dropped or handled roughly, the inertial effect of the document can be sufficient to force the ring elements open. This releases the document, causing paper to be scattered. This can be a particular problem with large binders holding reference material in public locations, eg. libraries etc., where they may be subjected to abuse and not be handled carefully.

Accordingly, it is desirable that a ring mechanism should securely retain all papers at all times. This should be the case even for large and heavy volumes of paper. Simultaneously, the ring mechanism should still be capable of easy operation, permitting ready removal and insertion of pages.

SUMMARY OF THE PRESENT INVENTION

In accordance with the present invention, there is provided a ring mechanism for mounting on a support member, the ring mechanism comprising: a resilient cover rail having side edges and apertures adjacent to side edges thereof; first and second carrier rails nested in side by side relationship and held within the side edges of the cover rail, the combined width of the carrier rails being greater than the width between the side edges when the cover rail is unstressed, whereby the carrier rails may be moved between opened and closed over centre positions; a plurality of pairs of first and second ring elements, which are mounted on the first and second carrier rails respectively and extend through said apertures on opposite sides of the cover rail, each pair of first and second ring elements including complementary mesh ends, which mesh with one another to form a closed loop to retain sheet articles on the rings, when the carrier rails are in the closed over centre position, and which are spaced apart to permit removal and mounting of sheet articles on the ring elements when the carrier rails are in the open over centre position; and manually operable locking means which can be moved between a locking position in which the carrier rails are locked in the closed over centre position, thereby preventing opening of the ring elements, and a disengaged position permitting movement of the carrier rails.

It is to be appreciated that, as a practical matter, the degree of security and prevention provided by the locking means will be subject to the dimensions and materials of the ring mechanism. The ring elements themselves usually have some degree of resiliency, and accordingly even if the carrier rails are held rigidly in the closed over centre position, sufficient force applied to the ring elements will force them apart. However, with the carrier rails secure, if the ring are suitably dimensioned, they can be stiff enough to withstand typical loads encountered in use, without spilling any of their contents.

Preferably, the locking means includes a locking member with lobes. The inner edges of the carrier rails then have complementary slots, so that the lobes can be aligned with the slots, to permit free movement of the carrier rails. Alternatively, the locking member can be rotated, to engage the carrier rails and lock them in the closed position.

Another embodiment of the present invention provides a ring mechanism for mounting on a support member, the ring mechanism comprising; a resilient cover rail having side edges and apertures adjacent the side edges thereof; carrier means within the cover rail, movable between open and closed positions; biasing means for urging and maintaining the carrier means in the open and closed positions; ring elements mounted on the carrier means and extending upwardly through the apertures of the cover rail, the ring elements being arranged in pairs, with the ring elements of each pair extending upwardly adjacent respective sides of the cover rail and including complementary mesh ends, which mesh with one another to form a closed loop when the carrier means is in the closed position and which are spaced apart when the carrier means is in the open position; and manually operable locking means, which can be moved between a locking position in which the carrier means is locked in the closed position and an open position permitting free movement of the carrier means.

The present invention also provides a loose leaf binder, incorporating a ring mechanism as defined above.

BRIEF DESCRIPTION OF THE DRAWINGS

For a better understanding of the present invention, and to show more clearly how it may be carried into effect, reference will now be made, by way of example, to the accompanying drawings, in which.

DESCRIPTION OF THE PREFERRED EMBODIMENT

Figure 1:
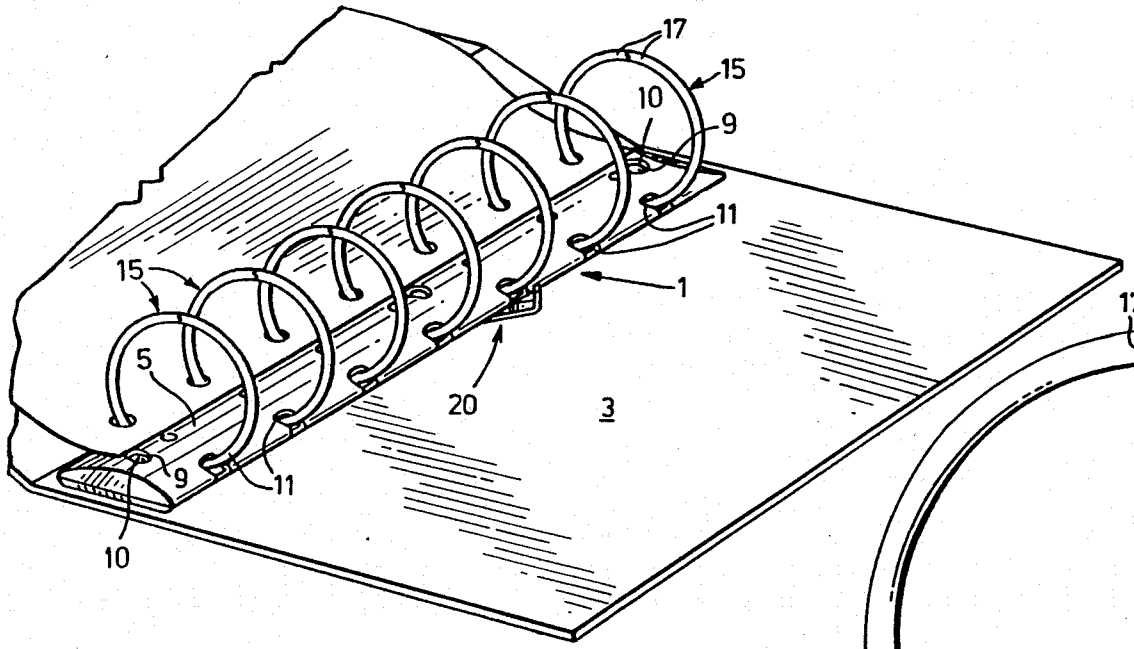
FIG. 1 is a perspective view of a ring mechanism mounted on a loose leaf binder according to the present invention.

Referring first to FIG. 1, there is shown a ring mechanism 1 mounted on a loose leaf binder 3. In known manner, the mechanism 1 is mounted on the rear face of the binder 3, which includes a spine member and a front member which can be folded over to close the binder.

Some of the components of the ring mechanism 1 are conventional, and for this reason these are only described in outline below.

The ring mechanism 1 has a cover rail 5. The cover rail 5 includes side edges 7, which are turned in. At either end of the cover rail 5, there are indentations and openings 9, in which tubular mounting elements (not shown) are secured. These mounting elements enable the ring mechanism 1 to be secured to the binder 3 by rivets in known manner. Along either side of the cover rail 5, there are apertures 11, for ring elements. The apertures 11 are arranged in pairs. As shown in FIG. 1, there are 7 pairs of apertures 11, for corresponding pairs of ring elements, the ring elements being detailed below. However, the exact number of apertures and ring elements an be chosen to suit a particular function. Often, a smaller number of ring elements will be provided.

Figure 2:
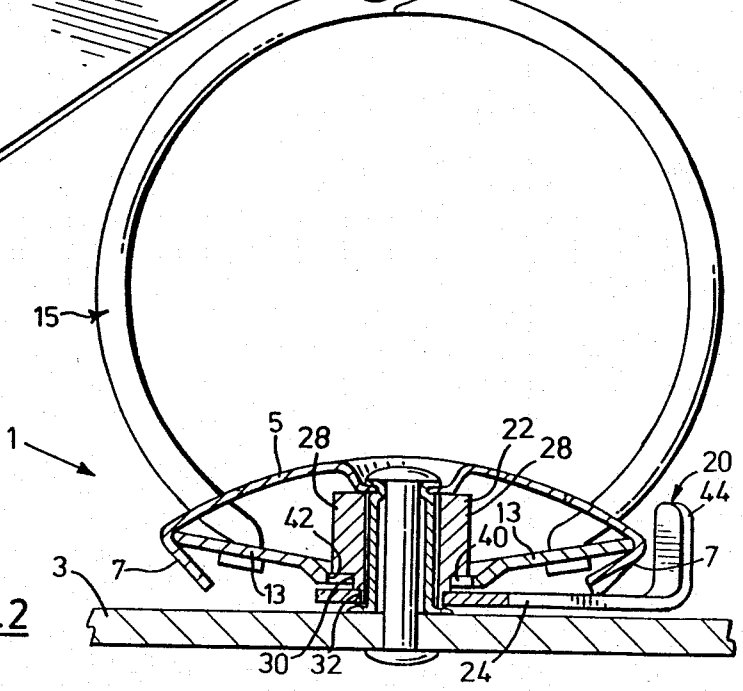
FIG. 2 is a sectional view, along the axis of the ring mechanism, of the ring mechanism and binder of figure 1, with the ring mechanism closed.

Within the cover rail 5 there are a pair of carrier rails 13. These carrier rails 13 are generally identical. The carrier rails 13 are mounted in a nested side by side arrangement, between the turned in side edges 7 of the cover rail 5. The total width of the carrier rails 13 is greater than the width between the side edges 7, in the unstressed condition. Accordingly, the cover rail 5 applies a compressive, resilient biasing force to the outer edges of the carrier rails 13. The inner edges 14 of the carrier rails are provided, in known manner, with notched or stepped portions engaging one another, to maintain these inner edges in engagement. This arrangement enables the carrier rails 13 to be moved between open and closed over centre positions; the open over centre position being that in which the inner edges 14 of the carrier rails 13 are above the outer edges (FIG. 3) and the closed position having the inner edges below the outer edges (FIGS. 2 and 4), at an angle of 8°.

Ring elements 15 are mounted and secured to the carrier rails 13 in known manner. The ring elements 15 comprise first and second ring elements on either side of the mechanism 1, arranged in pairs of first and second ring elements. Each ring element 15 extends upwardly through a respective aperture 11. The pairs of ring elements 15 include complementary mesh ends 17. With the carrier rails in the closed over centre position (FIG. 2), the mesh ends engage one another to form a closed loop, for retaining suitably perforated sheets of paper or other sheet articles. With the carrier rails 13 in the open over centre position, then the mesh ends 17 are spaced apart (FIG. 3), to permit removal and insertion of paper etc.

Again, whilst circular ring elements 15 are shown, it will be readily appreciated that, as is known in the art, a wide variety of ring element profiles can be employed.

Similarly, the size and disposition of the apertures 11 can be varied to suit the ring elements 15 used.

Further, as is known, the ring mechanism 1 can include boosters or triggers at either end. These are elements pivotally mounted in the cover rail 5 and arranged to engage the carrier rails 13. They are used to open and close the ring mechanism 1. In the absence of such boosters or triggers, the ring mechanism 1 is opened and closed by simply grasping a pair of ring elements 15.

In any event, whether the ring mechanism 1 is operated by grasping the ring elements 15 or by means of additional boosters and triggers (not shown), the various components have to be dimensioned so that the forces involved are reasonable and the mechanism can be readily operated manually. As a consequence, the force maintaining the ring elements 15 in the closed configuration can never be too great. In use, it is possible for the ring elements 15 to burst open, spilling the contents of the binder 3. This can occur, for example, if the binder 3 is dropped, or in transit where the binder 3 is packed in a case and subject to unusual loads. This is a particular problem with large, well filled binders. It will further be appreciated that in the case of such binders, the problem of rearranging and reinserting the contents is greater than for a lightly filled binder.

Accordingly, in accordance with the present invention, there is provided a locking mechanism, generally denoted by the reference 20. The locking mechanism 20 includes a locking member 22, and an actuating lever 24.

The locking member 22 is in the form of a generally solid body having a generally uniform cross-section along most of its length. The member 22 has a tubular bore 26. The locking member 22 is further generally symetrical about a vertical plane and includes two rounded and diametrically opposed lobes 28.

At its lower end, the locking member 22 includes a first cylindrical portion 30, and beneath this a second cylindrical portion 32 of smaller diameter.

The locking or actuating lever 24 is stamped from sheet metal, and includes a central bore, that fits the second cylindrical portion 32. The initial shape of the locking member 22 includes an extension of the cylindrical portion 32. During manufacturing this is deformed or pressed, so that it clamps the lever 24 to the locking member 22.

Figure 4:
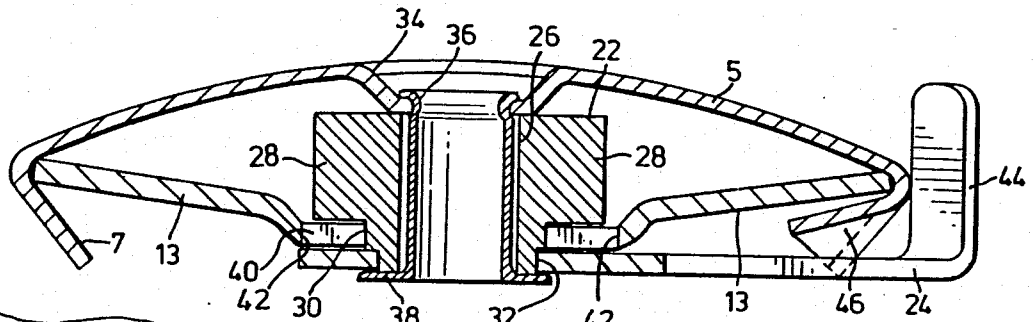
FIG. 4 is a sectional view of the cover and carrier rails of the ring mechanism, on a larger scale.

As shown most clearly in FIG. 4, the cover rail 5 includes a depression and opening 34. An eyelet 36 is mounted in this depression and opening 34. The locking member and lever 22, 24 are rotatably mounted on the eyelet 36, and the lower end of the eyelet 36 is pressed, to form a lower flange 38.

It will be appreciated that the locking member 22 and actuating lever 24 can be secured together in many ways. The essential requirement is that the lever 24 causes the locking member 22 to rotate. For this purpose, the bore in the lever 24 and the portion 32 could have, for example, corresponding square profiles. In this case, there would be no need for the locking member 22 to clamp the actuating lever 24 to it. Instead, the lower flange of the eyelet 36 could be used to retain the locking lever 24 on the locking lever 22.

The actual length of the first cylindrical portion 30 is somewhat greater than the thickness of the carrier rails 13. In turn, each carrier rail 13 includes, adjacent its inner edge 14 an offset portion 40. This portion 40 is offset at an angle to the rest of the respective carrier rails 13. Each of said portions 40 includes a slot 42 corresponding in shape to the lobes 28. As shown in FIG. 4, the offset portions 40 are orientated such that, in the closed position of the carrier rails 13, the offset portions 40 are generally horizontal and in a common plane with the first cylindrical portion 30.

The lever 24 includes a vertical extension 44 for ease of operation. Further, to accommodate the lever 24 under the cover rail 5, a part of one side edge 7 is pressed upwardly, to form a depressed part 46. This depressed part 46 is of a length to provide room for operation of the lever 24, when the binder mechanism 1 is mounted on a binder 3.

Figure 6:
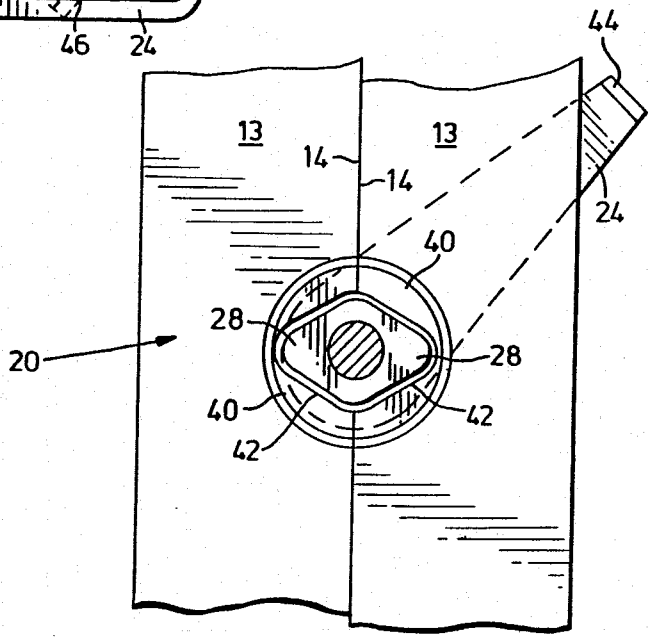
FIGS. 5 and 6 are plan views of the carrier rails and locking member of the ring mechanism.
Figure 5:
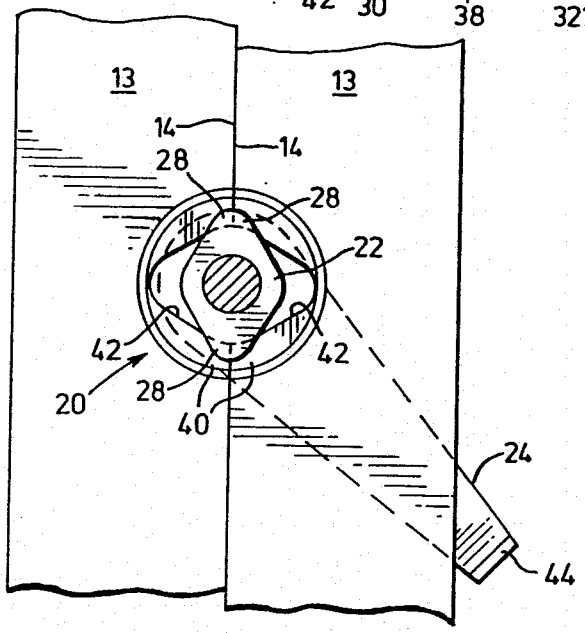

FIGS. 5 and 6 show just the carrier rails 13 and the locking mechanism 20, and will be referred to principally to describe the operation of the ring mechanism 1.

Commencing from the closed position of FIG. 1, the carrier rails 13 are then in the position as shown in FIG. 4. Here, the offset portions 40 are aligned with the cylindrical portions 30, so as not to obstruct the lobes 28. Accordingly, the operating lever 24 can be moved as indicated by the arrow 48 in FIG. 1, between a locking or closed position and an open or disengaged position, the open position being shown in FIG. 1.

As shown in FIG. 6, in the open position, the lobes 28 are aligned with the slots 42 of the carrier rails 13. Accordingly, the mechanism 1 can be opened. Once the mechanism 1 is open (FIG. 3), the slots 42 are located around the lobes 28. This will prevent movement of the locking member 22 and actuating lever 24. In the open position, sheets of paper or the like can be removed from, or placed on, the ring elements 15 in known manner.

The ring elements 15 can then be closed. This returns the carrier rails 13 to the position of FIG. 4. The slots 42 no longer embrace the lobes 28, freeing the locking member 22. the lever 24 can then be actuated, to rotate the locking member 22 through approximately 90° to the position as shown in FIG. 5. Here, the lobes 28 lie along the inner edges 14 of the carrier rails 13, with parts of the offset portions 40 trapped between the lobes 28 and the actuating lever 24. Accordingly, if any attempt is made to open the ring elements 15, the carrier rails 13 will be prevented from movement by the lobes 28. This secures the ring elements 15 in the closed position.

It will thus be seen that the locking mechanism 20 provides a simple and secure way of securing the ring elements 15 in the closed position. The actuating lever 24 is simple and unobstructive. It should not accidentally, for example in transit, be moved from the locking to the disengaged position, permitting the ring elements 15 to open spilling the contents of the binder 3.

The locking mechanism 20 should preferably be located centrally along the ring mechanism 1. The carrier rails 13 have a certain natural resilience, particularly in torsion. Accordingly, if it was located at one end of the carrier rails 13, it is possible that the other ends of the carrier rails and hence the associated ring elements could open to a certain extent. This would then permit at least partial spilling with the sheets becoming partly disengaged. In the embodiment shown, the locking mechanism 20 is offset axially from the central pair of ring elements 15. For easier manufacture, the carrier rails 13 are preferably made as identical as possible. To this end, each carrier rail 13 is first cut with a pair of slots 42 spaced symetrically on either side of the centre thereof. Then, just one offset portion 40 is stamped around the associated slot 42. This leaves a pair of slots 42 spaced from the locking mechanism 20.

Figure 3:
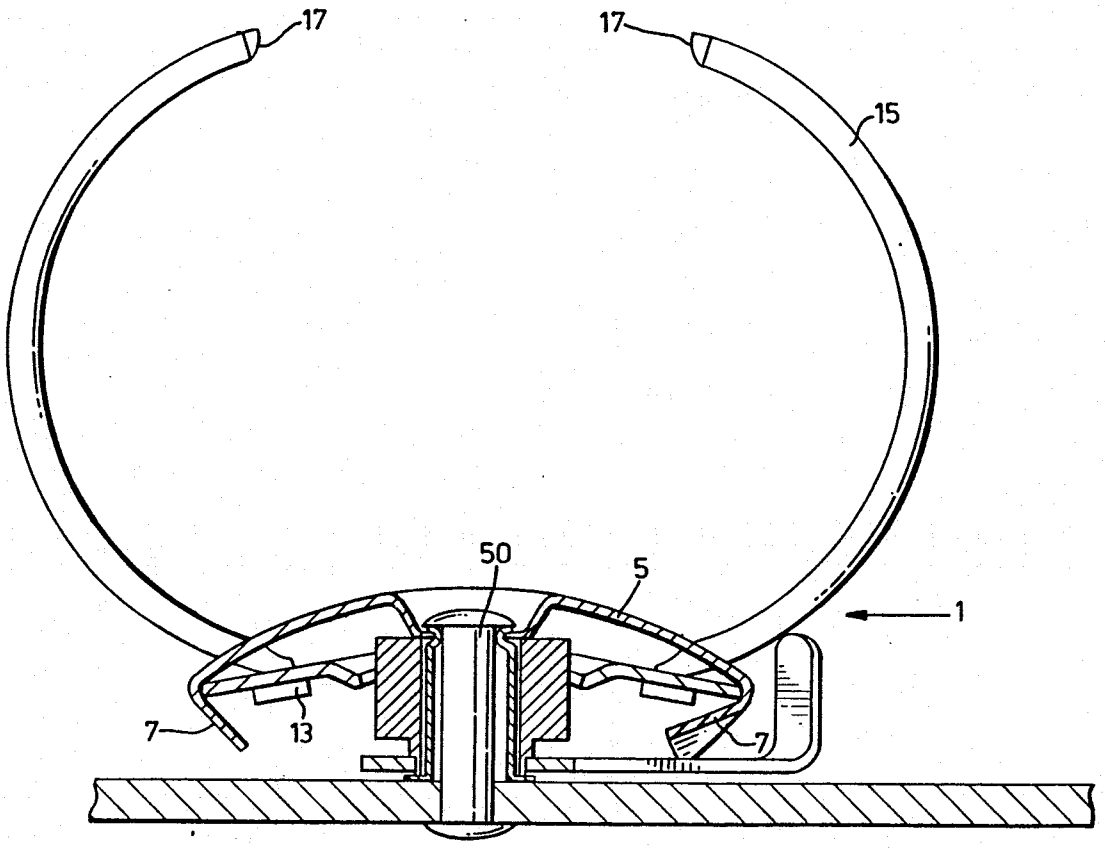
FIG. 3 is a sectional view similar to FIG. 2, showing the ring mechanism open.

Further, the eyelet 36 can form one of the mounting elements for the ring mechanism 1. Thus, as shown in FIG. 3, a rivet 50 can be provided securing the mechanism 1 to the binder 3.

I claim:

1. A ring mechanism for mounting on a support member, the ring mechanism comprising: a resilient cover rail having side edges and apertures adjacent the side edges thereof; carrier means within the cover rail, movable between open and closed positions; biasing means for urging and maintaining the carrier means in the open and closed positions; ring elements mounted on the carrier means and extending upwardly through the apertures of the cover rail, the ring elements being arranged in pairs, with the ring elements of each pair extending upwardly adjacent respective sides of the cover rail and including complementary mesh ends, which mesh with one another to form a closed loop when the carrier means is in the closed position and which are spaced apart when the carrier means is in the open position, and manually operable locking means comprising a locking member pivotally mounted to the cover rail and a locking lever secured to the locking member and extending out from the cover rail for actuation of the locking member, the locking member being pivotal between a locking position in which the carrier means is locked in the closed position and an open position permitting free movement of the carrier means.

2. In combination, a ring mechanism as claimed in claim 3, 4 or 1 and a binder including a spine, with the ring mechanism mounted within the binder adjacent and generally parallel to the spine.

3. A ring mechanism for mounting on a support member, the ring mechanism comprising: a resilient cover rail having side edges and apertures adjacent the side edges thereof; first and second carrier rails nested in a side by side relationship and held within the side edges of the cover rail, the combined width of the carrier rails being greater than the width between the side edges when the cover rail is unstressed, whereby the carrier rails may be moved between open and closed over centre positions; a plurality of pairs of first and second ring elements, which are mounted on the first and second carrier rails respectively and extend through said apertures on opposite sides of the cover rail, each pair of first and second ring elements including complementary mesh ends, which mesh with one another to form a closed loop to retain sheet articles on the rings when the carrier rails are in the closed over centre position, and which are spaced apart to permit removal and mounting of sheet articles on the ring elements when the carrier rails are in the open over centre position; and manually operable locking means comprising a locking member pivotally mounted to the cover rail and a locking lever secured to the locking member and extending out from the cover rail for actuation of the locking member, the locking member being pivotal between a locking position in which the carrier rails are locked in the closed over centre position, thereby preventing opening of the ring elements, and a disengaged position permitting movement of the carrier rails.

4. A ring mechanism as claimed in claim 3, wherein the locking member is generally symetrical and includes diametrically extending lobes, and wherein each carrier rail includes, in an inner edge thereof abutting the other carrier rail a slot having a profile corresponding to that of the lobes, the slots of the carrier rails facing one another, and being aligned with the lobes in the disengaged position.

5. A ring mechanism as claimed in claim 4, wherein each carrier rail includes an offset portion, with the offset portions being at similar angles to their respective carrier rails and being generally coplanar when the carrier rails are in the closed over centre position, and with the slots being provided in the offset portions.

6. A ring mechanism as claimed in claim 1, 4 or 5, wherein the locking means is generally centrally located along the ring mechanism.

7. A ring mechanism as claimed in claim 1 or 5, wherein the locking lever extends out from underneath the cover rail.

8. A ring mechanism as claimed in claim 7, and wherein one side edge of the cover rail includes a depressed part on the underside thereof, to accommodate the locking lever.

9. A ring mechanism as claimed in claim 7, wherein one side edge of the cover includes a depressed part on the underside thereof to accommodate the locking lever, and wherein the locking member comprises a main part including the lobes, a first cylindrical portion which is aligned with the offset portions of the carrier rails in the closed over centre position and which is beneath the lobes, and a second portion beneath the first cylindrical portion to which the locking lever is attached.

10. A ring mechanism as claimed in claim 9, wherein the locking member includes a cylindrical bore, and which includes an eyelet means extending through the bore of the locking member and rotatably securing the locking member and locking lever to the cover rail.

11. A ring mechanism as claimed in claim 9, wherein the locking lever includes a vertical extension at a free end thereof, to assist actuation of the locking lever.

* * * * *